US006336806B1

(12) United States Patent
Paschereit et al.

(10) Patent No.: US 6,336,806 B1
(45) Date of Patent: Jan. 8, 2002

(54) METHOD FOR COMBUSTION OF A LIQUID FUEL IN A COMBUSTION SYSTEM, AND A COMBUSTION SYSTEM FOR CARRYING OUT THE METHOD

(75) Inventors: Christian Oliver Paschereit, Baden (CH); Wolfgang Polifke, Freising (DE); Christian Steinbach, Neuenhof (CH)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/615,950

(22) Filed: Jul. 13, 2000

(30) Foreign Application Priority Data

Jul. 14, 1999 (DE) ..... 199 42 387

(51) Int. Cl.[7] ..... F23D 11/32

(52) U.S. Cl. ..... 431/1; 431/2; 431/19; 431/75; 431/114; 60/39.77; 60/725

(58) Field of Search ..... 431/1, 2, 19, 75, 431/114; 123/538; 60/725, 39.77, 39.06; 239/6, 690, 708, 692, 101

(56) References Cited

U.S. PATENT DOCUMENTS 3,749,545 A * 7/1973 Velkoff ..... 431/2
4,439,980 A * 4/1984 Biblarz et al. ..... 60/39.06
5,145,355 A * 9/1992 Poinsot et al. ..... 431/1
5,297,738 A * 3/1994 Lehr et al. ..... 239/708
5,695,328 A 12/1997 Defreitas et al.
5,791,889 A * 8/1998 Gemmen et al. ..... 431/1

FOREIGN PATENT DOCUMENTS

EP 0321809 B1 * 6/1989

* cited by examiner

*Primary Examiner*—Sara Clarke
(74) *Attorney, Agent, or Firm*—Burns, Doane, Swecker & Mathis, L.L.P.

(57) ABSTRACT

In a method for burning a liquid fuel in a combustion system (10) which comprises a combustion chamber (11) and at least one injection nozzle (13) through which liquid fuel is injected into the combustion chamber (11) in the form of a fuel spray (16) and is burnt there with combustion air being added, disturbance-free operation in a simple manner is distinguished in that, in order to actively suppress hydrodynamic instabilities in the combustion chamber (11), the injected fuel spray (16) is modulated by having an electrical voltage applied to it during the injection process, governed by a selected time function.

8 Claims, 1 Drawing Sheet

Figure 1:
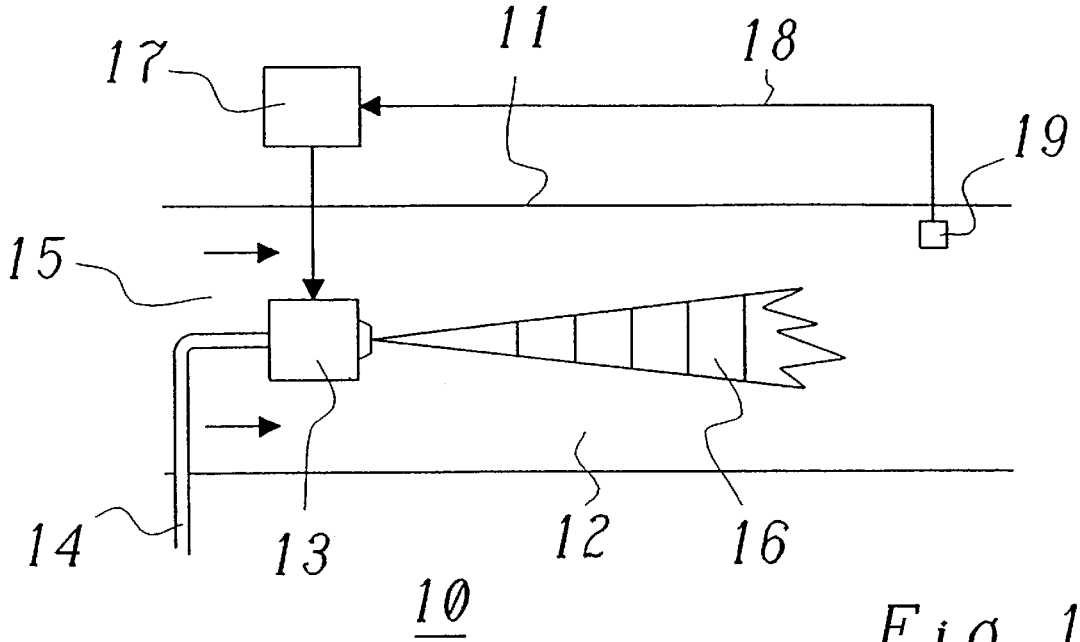

METHOD FOR COMBUSTION OF A LIQUID FUEL IN A COMBUSTION SYSTEM, AND A COMBUSTION SYSTEM FOR CARRYING OUT THE METHOD

BACKGROUND OF THE INVENTION

1. Field of the Invention

The present invention relates to the field of combustion technology. It relates to a method for burning a liquid fuel in a combustion system.

2. Description of the Related Art

Thermoacoustic oscillations represent a danger to all types of combustion applications. They lead to high-amplitude pressure fluctuations, to constriction of the operational range, and can increase undesirable emissions. This affects, in particular, combustion systems with little acoustic damping, such as those used in gas turbines. Active control of the combustion oscillations may be required to guarantee high performance with regard to pulsations and emissions over a wide operating range.

Various techniques for controlling and suppressing combustion instabilities by means of an active control system have already been proposed, in which, using either an open or a closed control loop, the supply of fuel and/or combustion air to the burner or to the burners is controlled or modulated in a defined manner. A prior, not previously published application from the applicant relates, for example, to active control of the instabilities in a premixing burner and is illustrated, for example, in FIG. 1 of EP-B1-0 321 809. In such a premixing burner, the fuel flows in the two outer fuel lines (8, 9 in FIG. 1 of EP-B1-0 321 809) are modulated asymmetrically in an open loop at frequencies between 0.3 Hz and 5 kHz, preferably between 5 Hz and 200 Hz. The modulation process is carried out with the aid of two fuel valves which are inserted in the fuel lines.

A disadvantage with the use of mechanically moving, electrically driven fuel valves is that they have mechanically moving parts which not only limit the range of the modulation frequency but, at the modulation frequencies which are used, are also subject to increased wear and whose functional reliability is subject to limitations. Another disadvantage is the relatively high power required by the valves themselves, which makes considerable additional circuit measures necessary.

SUMMARY OF THE INVENTION

The object of the invention is to provide a combustion method and a combustion system which effectively suppress thermoacoustic combustion instabilities in a simple and effective manner and without any mechanically moving parts by modulation over a wide frequency range.

The essence of the invention is for the liquid fuel to be injected with electrostatic assistance. The application of an electrical voltage to the fuel allows the spray angle and the range of the injected fuel spray, the atomization and the resultant droplet size distribution, with the vaporization and distribution of the fuel to be influenced. If this influencing process is carried out in accordance with a predetermined, selected time function, the combustion flame and thus the instantaneous rate at which heat is released can be modulated appropriately. Since the instantaneous rate at which heat is produced represents the most important single factor in the production and suppression of thermoacoustic combustion instabilities, the instabilities can effectively be suppressed by suitable selection of the time function and other modulation variables.

According to one preferred embodiment of the method according to the invention, a high voltage of several kV is used for modulation and is, in particular, a pulsating DC voltage, with a periodic function being used as the time function.

In this case, the high voltage can on the one hand be modulated in an open control loop. This is justified in particular if the instabilities in the combustion chamber have a response which is constant over time and can be suppressed or attenuated by selection of a suitable fixed time function.

If, on the other hand, the instabilities vary with time or as a function of various changing operating parameters, it is expedient and advantageous to monitor the hydrodynamic instabilities continuously by measuring suitable variables, in particular the instantaneous rate at which heat is released or the pressure pulsations, and to carry out the modulation process in a closed control loop, including the measured variables.

The combustion system according to the invention, which comprises a combustion chamber and at least one injection nozzle through which liquid fuel is injected into the combustion chamber, is distinguished in that first means are provided in order to apply an electrical voltage to the liquid fuel during the injection process.

One preferred embodiment of the combustion system according to the invention is distinguished in that the injection nozzle comprises a nozzle bore and a fuel channel which leads to the nozzle bore, in that the fuel in the fuel channel has the modulating electrical voltage applied to it, in that the injection nozzle comprises a nozzle body in which the nozzle bore is arranged, in that the fuel channel is formed between the nozzle body and an insert which is inserted with a gap into a recess in the nozzle body and is electrically insulated from the nozzle body, and in that the modulating electrical voltage is applied between the nozzle body and the insert.

BRIEF DESCRIPTION OF THE DRAWING FIGURES

Figure 2:
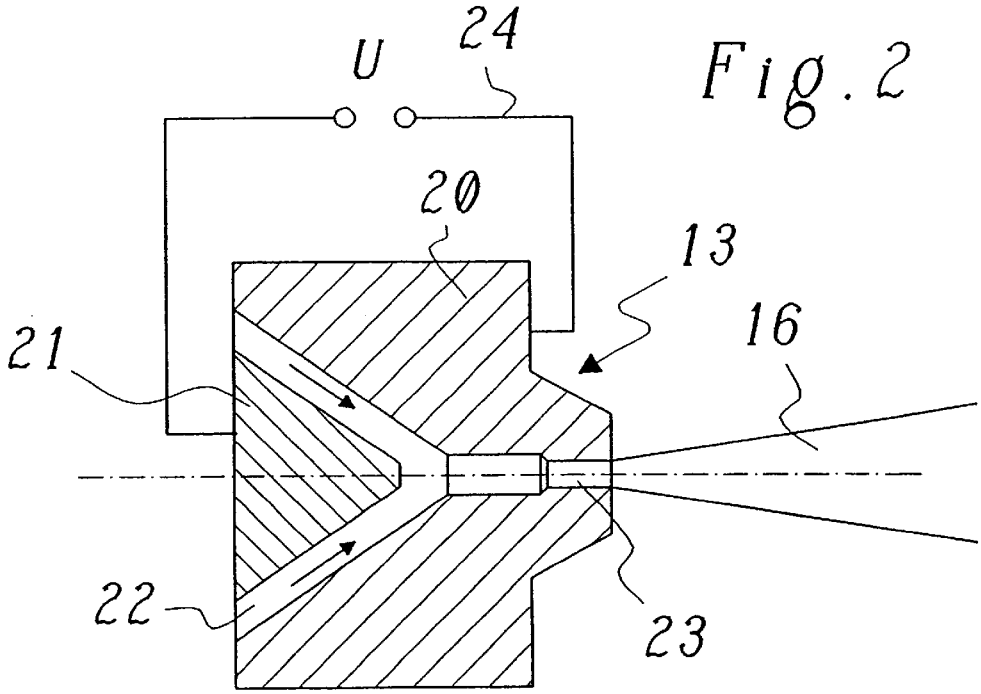

The invention will be explained in more detail in the following text with reference to exemplary embodiments and in conjunction with the drawing, in which:

FIG. 1 shows a schematic arrangement of a combustion system according to a preferred exemplary embodiment of the invention having a closed control loop; and FIG. 2 shows a longitudinal section through an injection nozzle, suitable for electrostatic modulation, as shown in FIG. 1.

DETAILED DESCRIPTION OF THE PREFERRED EMBODIMENTS

FIG. 1 shows a schematic illustration of the arrangement of a combustion system according to a preferred exemplary embodiment of the invention and having a closed control loop. The combustion system 10 comprises a combustion chamber 11 in whose interior 12 an injection nozzle 13 for injection of a fuel spray 16 of liquid fuel is arranged. The liquid fuel (for example oil) is supplied to the injection nozzle 13 from the exterior via a fuel line 14. The necessary combustion air enters the combustion chamber through an air inlet 15. The fuel nozzle 13 is connected via supply lines to a controlled voltage source 17, which emits a pulsed or clocked DC voltage in the high-voltage range of several kV, for example 10 to 20 kV. The clock frequency is governed predominantly by the thermoacoustic combustion instabilities which can occur in the combustion chamber 11, and is selected such that these instabilities are suppressed or are at least highly attenuated. The frequencies may in this case be in the range from several Hz to several kHz. The controlled voltage source 17 may on the one hand be permanently set to the optimum clock frequency or time function. The control loop for suppressing the instabilities is then an open control loop. The voltage source 17 may, however, also—as is shown in FIG. 1 —be controlled by a sensor element, for example a pressure transducer 19, which records the instabilities (pressure fluctuations) in the combustion chamber 11 and passes on appropriate signals via a signal line 18 for control purposes to the voltage source 17. In this case, the control process is carried out in a closed control loop. However, the instantaneous rate at which heat is released may also be measured, for example by measuring the OH radiation intensity, and used for control purposes, instead of the pressure pulsations when using the pressure transducer 19.

The pulsed high voltage from the voltage source 17 modulates the fuel spray 16 in the injection nozzle 13 (indicated in FIG. 1 by the periodic vertical lines in the fuel spray). The application of electrostatic voltages to the liquid droplets allows various parameters relating to the fuel spray 16 to be influenced, such as

- the spray angle and the range of the spray;
- the atomization and the droplet size distribution resulting from it; and
- the vaporization of the fuel droplets and the fuel distribution.

For their part, these parameters influence—by varying the ignition delay times, the local equivalence relationships, etc.—the point of fuel consumption and thus the flame position. If the high voltage on the injection nozzle is varied (by the pulsation), this allows the instantaneous rate at which heat is produced in the combustion chamber 11 to be modulated, this being the most important single factor for the production, and thus for the active suppression as well, of the thermoacoustic combustion instabilities.

The high voltage can be applied to the injected fuel in an injection nozzle 13, a longitudinal section of which is shown in FIG. 2. The injection nozzle 13 comprises a nozzle bore 23 and a fuel channel 22 which leads to the nozzle bore 23. The modulating electrical voltage is applied to the fuel in the fuel channel 22. To this end, the injection nozzle 13 comprises a nozzle body 20 in which the nozzle bore 23 is arranged. The fuel channel 22 is formed between the nozzle body 20 and an insert 21 which is inserted with a gap into a recess in the nozzle body 20 and is electrically insulated from the nozzle body 20. The modulating electrical voltage U, which is connected via two terminals 24, is applied between the nozzle body 20 and the insert 21. The fuel flowing through the fuel channel 22 thus passes through a DC voltage field oriented at right angles to the flow direction and is modulated in the manner described above in accordance with the time function of the applied voltage.

The advantages of such an injection nozzle which can be modulated electrostatically over mechanical solutions such as fast-switching valves or rotating devices are obvious:

- there are no moving parts; high modulation frequencies up to several khz can thus be achieved without any problems;
- the simple design without any moving parts results in high reliability and low construction and servicing costs;
- the fuel mass flow rate remains constant, that is to say no mechanical work is carried out, and the power requirement is thus low;
- the acoustic impedance of the fuel line 14 cannot influence the response of the modulation device since the nozzle bore 23 terminates the fuel line 24; and
- the control process can be carried out without any problems both in an open control loop and in a closed control loop.

What is claimed is:

1. A method for burning a liquid fuel in a combustion system which comprises a combustion chamber and at least one injection nozzle through which liquid fuel is injected into the combustion chamber in the form of a fuel spray and is burnt there with combustion air being added, wherein, in order to actively suppress hydrodynamic instabilities in the combustion chamber, the injected fuel spray is modulated by having an electrical voltage applied to it during the injection process, governed by a selected time function.

2. The method as claimed in claim 1, wherein a high voltage of several kV is used for modulation.

3. The method as claimed in claim 2, wherein the high voltage is a pulsating DC voltage.

4. The method as claimed in claim 1, wherein a periodic function is used as the time function.

5. The method as claimed in claim 1, wherein the modulation is carried out in an open control loop.

6. The method as claimed in claim 1, wherein the hydrodynamic instabilities in the combustion chamber are monitored continuously by measuring variables, and wherein the modulation process is carried out in a closed control loop, including the measured variables.

7. The method as claimed in claim 6, wherein the hydrodynamic instabilities in the combustion chamber are monitored continuously by measuring the instantaneous rate at which heat is released or the pressure pulsations, and wherein the modulation process is carried out in the closed control loop, including the measured instantaneous rate at which heat is released or the measured pressure pulsations.

8. A combustion system, comprising: a combustion chamber and at least one injection nozzle through which liquid fuel is injected into the combustion chamber, wherein first means are provided in order to apply an electrical voltage to the liquid fuel during the injection process, wherein the first means for applying an electrical voltage to the liquid fuel comprise a controlled voltage source and wherein the combustion chamber contains second means for monitoring or measuring hydrodynamic instabilities, and wherein the second means are operatively connected to the controlled voltage source.

* * * * *